United States Patent [19]

Eriksson

[11] Patent Number: 4,742,919

[45] Date of Patent: May 10, 1988

[54] ROTATING SEPARATOR

[75] Inventor: Arne Eriksson, Pittsfield, Mass.

[73] Assignee: Beloit Corporation, Beloit, Wis.

[21] Appl. No.: 865,812

[22] PCT Filed: Apr. 11, 1986

[86] PCT No.: PCT/US86/00718

§ 371 Date: Apr. 11, 1986

§ 102(e) Date: Apr. 11, 1986

[87] PCT Pub. No.: WO87/06279

PCT Pub. Date: Oct. 22, 1987

[51] Int. Cl.[4] ..... B07B 13/11; B07B 7/02

[52] U.S. Cl. ..... 209/44.1; 209/139.2; 209/145; 209/148; 209/631; 209/642

[58] Field of Search ..... 209/23, 28, 29, 138, 209/139.1, 139.2, 145, 146, 148, 350, 631, 632, 638, 641, 642, 643, 44.1, 30, 31, 33, 35, 37, 634

[56] References Cited

U.S. PATENT DOCUMENTS

| | | | |
|---|---|---|---|
| 225,859 | 3/1880 | Oexle | 209/145 |
| 231,395 | 8/1880 | Buhlmann | 209/145 |
| 459,267 | 9/1891 | Clarkson | 209/145 |
| 459,315 | 9/1891 | Stanfield et al. | 209/642 |
| 942,251 | 12/1909 | Ernst | 209/145 |
| 952,459 | 3/1910 | Meyer | 209/148 X |
| 1,017,056 | 2/1912 | Johnston | 209/148 X |
| 1,358,375 | 11/1920 | Koch | 209/145 |
| 1,517,509 | 12/1924 | Hokanson | 209/642 X |
| 2,466,309 | 4/1949 | Cannon et al. | 209/350 |
| 3,089,595 | 5/1963 | Kaiser | 209/148 X |
| 3,090,487 | 5/1963 | Doyle | 209/144 X |
| 3,615,008 | 10/1971 | Alpha | 209/148 X |
| 4,176,055 | 11/1979 | Corrigan | 209/144 X |
| 4,236,997 | 12/1980 | Wessel et al. | 209/144 |

FOREIGN PATENT DOCUMENTS

| | | | |
|---|---|---|---|
| 1482473 | 9/1970 | Fed. Rep. of Germany . | |
| 1251017 | 12/1960 | France . | |
| 0021212 | 10/1901 | United Kingdom | 209/642 |
| 0159163 | 8/1921 | United Kingdom | 209/138 |
| 0436566 | 10/1935 | United Kingdom | 209/138 |
| 1018020 | 1/1966 | United Kingdom . | |
| 1073925 | 6/1967 | United Kingdom . | |
| 1454444 | 11/1976 | United Kingdom | 209/148 |

*Primary Examiner*—Johnny D. Cherry
*Assistant Examiner*—Edward M. Wacyra
*Attorney, Agent, or Firm*—Dirk J. Veneman; Raymond W. Campbell

[57] ABSTRACT

Fines are separated from pin chips and a system in which a mixture of fines and pin chips is introduced onto a rotating disk which imparts centrifugal forces thereto for separation. In a first embodiment, the fines and the pin chips are propelled over different length paths to fall into separate collectors, the fines collector entraining the fines into an air stream for disposal. In this embodiment, the rotor comprises a rotary disk having a smooth upper surface, while in a second embodiment the upper surface is provided with a plurality of vanes on the upper surface thereof. In a third embodiment, the rotary disk is provided with a plurality of grooves for directing the fines over the periphery of the disk into its collector. In a fourth embodiment, the rotary disk is provided with a plurality of generally radial slots with vanes beneath in order to provide a classification between fines and pin chips.

17 Claims, 3 Drawing Sheets

10
12
14
16
18
20
22
24
26
28
30
32
34
36
38
44
46
48
50
52
54
56
58
60
62
64
A
B
C

ROTATING SEPARATOR

DESCRIPTION

The present invention relates to a separator, and is more particularly concerned with a rotating separator for separating fines from pin chips in pulp mills.

It is important in pulp mills to separate the fines from the pin chips, the fines usually being incinerated in that they do not have the required long fibers for papermaking.

Fine rotary screens, electrical dynamic separators, vibrating screens and the like, conventional today, are expensive or have a low efficiency.

The object of the present invention, therefore, is to provide a rotary separator which is cost-effective, efficient and controllable with respect to its separating capability.

The above object is achieved, according to the present invention, through the utilization of centrifugal force, together with an air stream, to separate the fines from the pin chips, to maintain the separation and to convey the fines for disposal. A mixture of fines and pin chips is fed by way of an inlet chute onto the center of a horizontal rotating disk which spreads and hurls the material beyond the periphery of the disk. Inasmuch as it has been shown that fine powder does not travel along a ballistic curve in air as well as a heavier particle, the pin chips travel outwardly along more defined ballistic curves while the fines travel lesser paths. Two concentric chambers are therefore formed below and beyond the periphery of the rotating disk, the outer chamber receiving the pin chips and the inner chamber receiving the fines. The outer chamber includes a discharge opening at the bottom thereof for discharging the pin chips onto a conveyor and for providing an air inlet for providing an air stream to communicate with the aforementioned air stream. The inner chamber, however, is a low pressure zone in communication with the air streams so that the fines received therein are entrained in the first-mentioned air stream and conveyed away for disposal.

In a first embodiment of the invention, the rotor comprises a rotating disk having a smooth upper surface for imparting centrifugal forces to the material. In a second embodiment, a plurality of arcuate vanes are provided on the upper surface for directing the material toward the periphery of the disk. In a third embodiment, the rotating disk comprises a plurality of grooves extending toward and opening at the periphery of the disk. In a fourth embodiment, the rotating disk comprises a plurality of spokes or vanes on its underside and a plurality of slots extending through the disk providing classification of the pin chips and fines, the fines falling through the slots into the inner chamber.

The rotating separator of the present invention is provided with a plurality of controls for modulating the centrifugal force, for modulating the dropping point of the material and for modulating the air stream which entrains the fines. The centrifugal force is modulated by controlling the speed of rotation which may be accomplished, for example, through the use of a variable speed drive. The dropping point may be modulated by adjusting the vertical height of the rotor. The air stream may be modulated, very simply, by the use of a variable damper.

BRIEF DESCRIPTION OF THE DRAWINGS

Referring to FIGS. 1 and 2, the separating system is illustrated as comprising a separator 10 in communication with a cyclone 12 by way of a fan 14.

Figure 1:
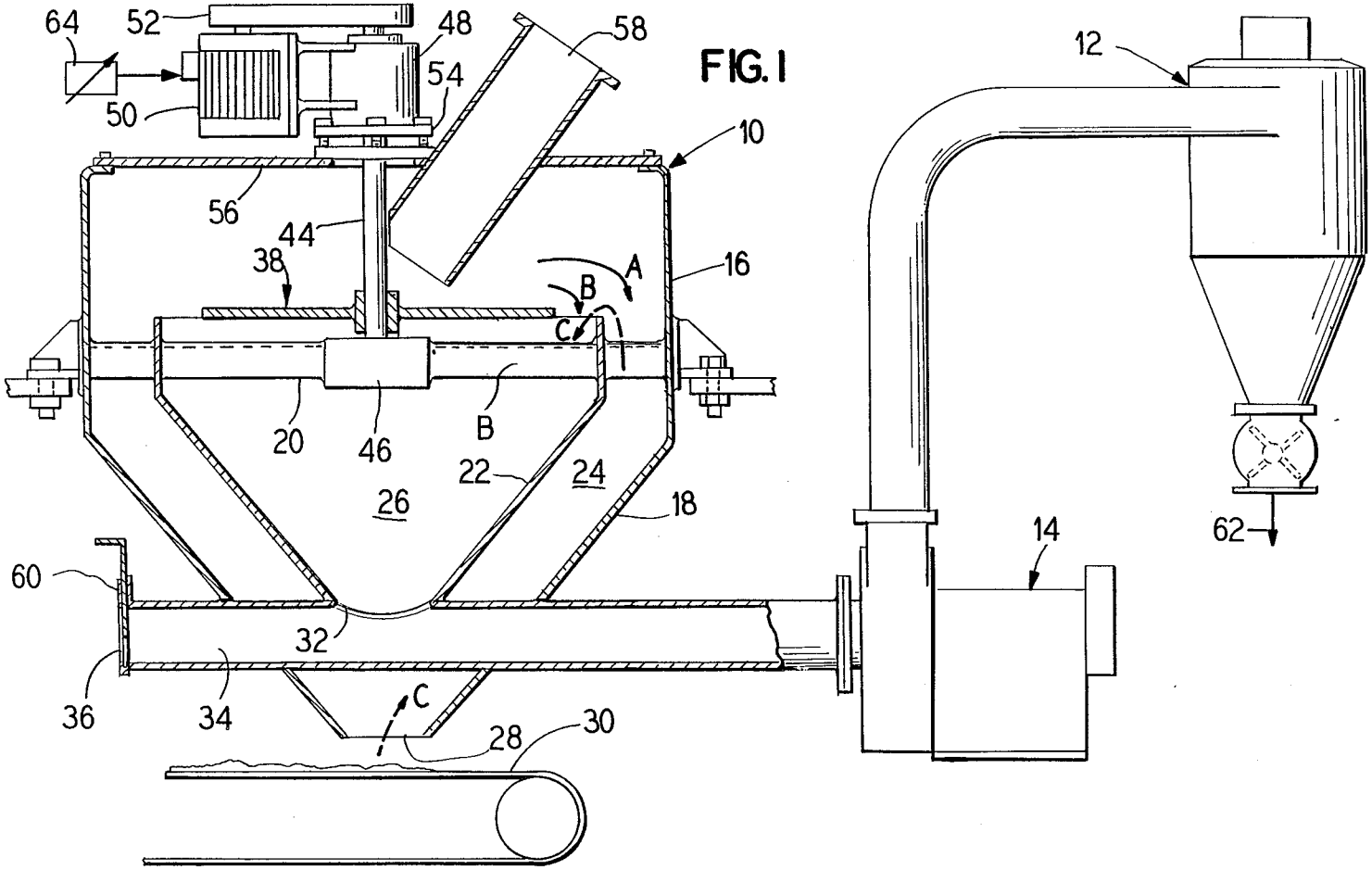
FIG. 1 is a schematic representation of a separating system comprising a separator, shown in section, a fan and a cyclone.

The separator 10 comprises a housing including an upper wall 16 a convergent lower wall 18 and a top wall 56. A crossbar structure 20 supports an inner wall 22 spaced from the wall 18 to define an outer chamber 24 and an inner chamber 26. The wall 18 also defines a discharge opening 28 for communication with a conveyor 30. The inner wall 22 defines, at its lower end, a discharge opening 32 in communication with a conduit 34. The conduit 34 supports a flow of air from a variable opening 36, controlled by a damper 60, through the fan 14 and the cyclone 12 to a discharge 62.

Figure 2:
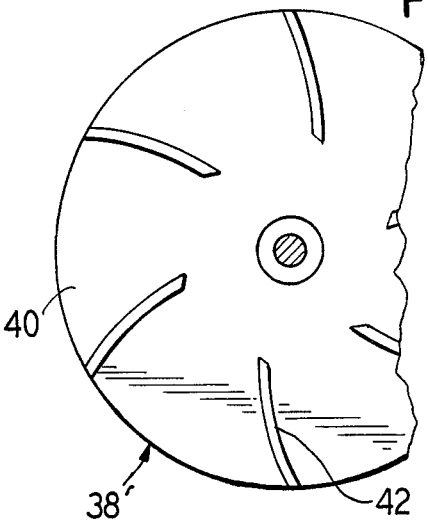
FIG. 2 is a fragmentary top plan view of a rotor which may be used in the apparatus of FIG. 1.

A rotor 38 is mounted for rotation above the chambers 24 and 26 and includes a smooth upper surface. As best seen in FIG. 2, the rotor 38' comprises a disk 40 carrying a plurality of arcuate vanes 42. The rotor 38 (FIG. 1) or 38' (FIG. 2) is mounted for rotation on a shaft 44 carried by a bearing 46 mounted on the crossbar 20. The shaft 44 is driven by way of a gearbox 48 coupled to a motor 50 by way of a coupling 52 such as a V-belt or other drive. The motor 50 may advantageously be a variable speed motor controlled by a variable speed motor controller 64 for modulating the centrifugal force provided by the rotor.

The bearing housing 48 is advantageously vertically adjustable, as by adjustment screws or lugs 54, for adjusting the vertical height of the rotor 38 and thereby modulating the dropping point of the material being separated.

The damper 60, of course, provides for modulation of the air stream traversed into the conduit 34.

In operation, a mixture of pin chips and fines is fed into the separator by way of an inlet chute 58 and directed to the central portion of the rotor 38 where the mixture is subjected to centrifugal force and flung over the periphery of the disk. The pin chips, have a lower surface area to mass ratio than the fines, traverse paths, as indicated at A, and are received in the chamber 24. The fines, on the other hand, traverse a path, as indicated at B, and are received in the chamber 26. All fines and flour which are received in the accepts chamber 24 and entrained in the air stream C and transported into the rejects chamber 26.

The pin chips are guided downwardly by the wall 18 to the discharge 28 and are transported away for processing on the conveyor 30. The fines, however, are received in a low-pressure zone in the chamber 26, due to the air stream C and the air flow through the conduit 34 and pass through the discharge opening 32 to be entrained in the air flow and transported to the cyclone 12 by way of the fan 14. Eventually, the fines are discharged, as indicated at 62, from the cyclone 12.

Figure 5:
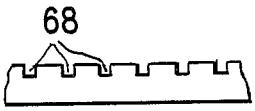
FIG. 5 is a fragmentary end view of the rotor of FIGS. 3 and 4.
Figure 3:
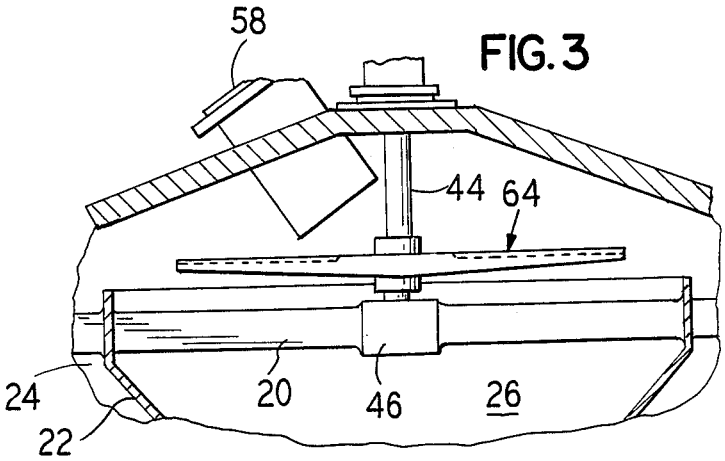
FIG. 3 is a fragmentary sectional view of a separator illustrating a third embodiment of a rotor constructed in accordance with the invention.
Figure 4:
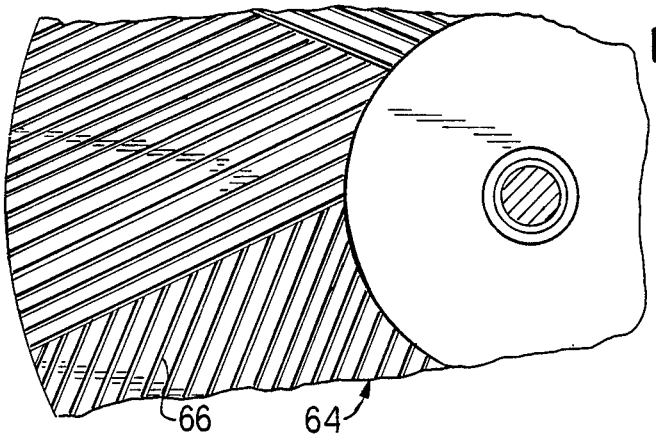
FIG. 4 is a fragmentary top plan view of the rotor of FIG. 3.

Referring to FIGS. 3, 4 and 5, a second embodiment of the invention is illustrated in which a rotor 64 is mounted for rotation with the shaft 44 and is journalled by a bearing 46 carried by the crossbar 20. The rotor 64 is constructed as a welded concave structure with its lower surface extending at an angle, for example 0.5°. As best seen in FIGS. 4 and 5, the rotor comprises a field 66 of grooves 68 which extend toward the periphery of the rotor. The grooves may be, for example, 0.188" deep and 0.188" wide. The purpose of the grooves is to collect as much fines as possible; therefore, the groove pattern is provided so that the grooves extend over longer distances than if the same were to extend radially. When the fines are in the grooves, they are forced by two frictional forces, namely downwardly and along a sidewall of the respective groove. As expected, with one force extending downwardly and the other against a groove wall causes a decrease in the radial speed of a fine particle so that the fines easily drop into the reject zone of the chamber 26. Experimental results have shown that the grooves increase the efficiency of the separator.

The grooves also shake off the fines attached to the pin chips. The pin chips function to prevent the grooves from plugging.

The air flow from the fan action through the rotary separator takes care of the smallest flying particles, decreases the flow length of the fines, and transports the fines to the reject zone of the chamber 26.

Figure 7:
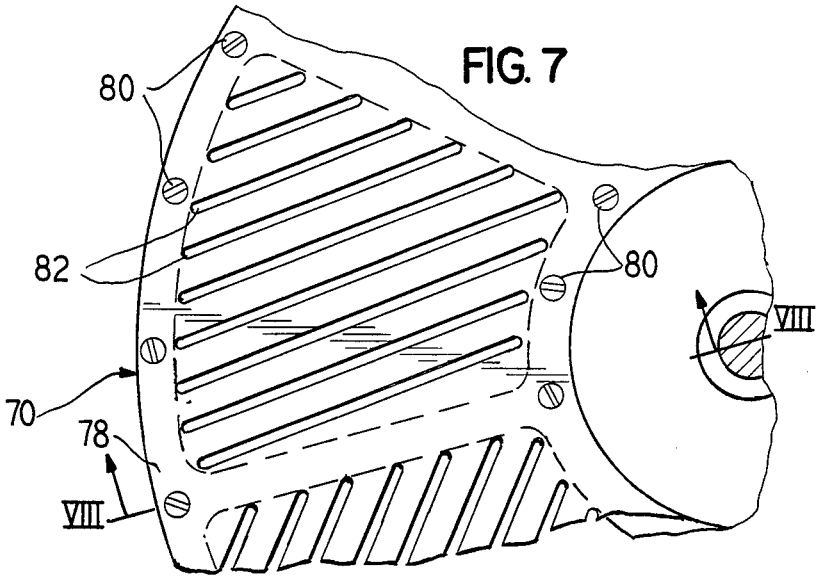
FIG. 7 is a fragmentary top plan view of the rotor illustrated in FIG. 6.
Figure 8:
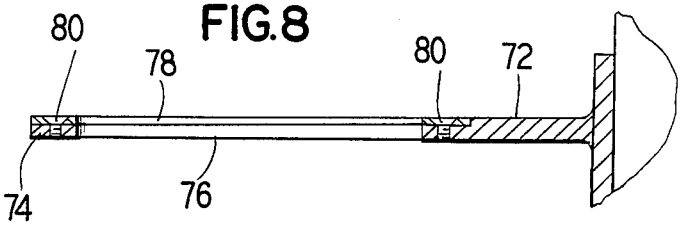
FIG. 8 is a sectional view taken substantially along the line VIII—VIII of FIG. 7.
Figure 6:
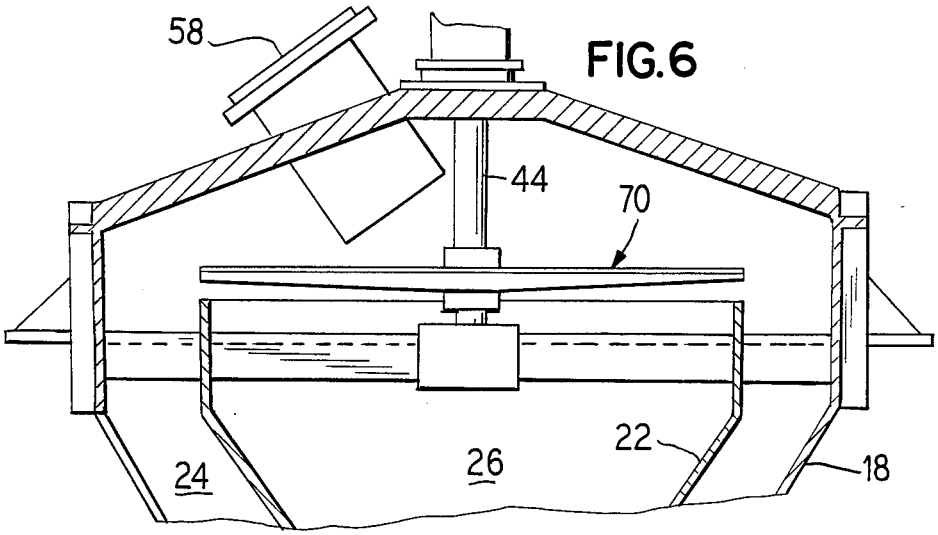
FIG. 6 is a fragmentary sectional view of a separator employing another embodiment of the rotor constructed in accordance with the present invention.

Referring to FIGS. 6, 7 and 8, a further embodiment of the invention is illustrated in which the separator is provided with a rotor 70.

The rotor 70, as best illustrated in FIGS. 7 and 8 comprises a pair of rings 72 and 74 connected together by a plurality of spaced spokes 76. A plate 78 is attached to the rings 72, 74 by way of a plurality of screws 80 and comprises a plurality of slots 82. With this structure it is possible to create an under-pressure above the rotor with the spokes or fan blade 76 below the rotor. The rotation of the rotor is opposite to that of the aforementioned rotor having grooves.

It should be noted that the chamber 26 in FIG. 6 is dimensioned such that it extends only beneath the rotor and, in this embodiment, the fines are classified through the slots 82.

It should also be noted that the embodiments of FIGS. 3–5 and 6–8 may also be employed in conjunction with a conduit 34 which supports an air flow to entrain the fines and convey the same for final disposition.

It is readily apparent that the foregoing description relates to a separator which is designed to separate one fraction of material (primarily wood chips) from one or more other constituents of a mixture. The material is fed onto the center of a horizontal rotating rotor and is thrown out by centrifugal forces in two or more sections. One section is the accepts and is received in an outer zone while another portion is the rejects or fines and is received in an inner zone. In order to control the system, air is used in a flow opposite to that of the material. The apparatus provides benefits and advantages compared to other systems which are primarily based on low cost, no holes or slots of the type which would normally become plugged such as in shaker screens, no large wear elements such as disk screens, a high efficiency, and ease of control, a sealed apparatus so that there is no dust problem, and high capacity.

A full size model of the present invention has been constructed and operated. Using only centrifugal forces imparted by the rotating plate, and without the air flow, a separation efficiency of 75% has been achieved, with some loss of capacity. The capacity and efficiency still equal or exceed existing separators. By using the air flow as discussed above, an 88% separation efficiency has been achieved. In other words, the separator works very well without the provision of an air flow and works extremely well when the air flow is employed.

One embodiment of the invention provides the rotor with special grooves developed for performance to separate flour from pin chips. The pattern of the grooves is illustrated in FIG. 4. The purpose of the grooves is to select as much fines/flour as possible and, because of the two frictional forces, a reduction of velocity as much as possible is provided before the particles leave the rotor. Therefore a negative rotation of the rotor is provided as illustrated in FIG. 4. Because of the energy of the particles and the air flow, the particles will go inside or outside of the inner cone. The grooves are self-cleaned by the larger particles. In the center it is possible to provide an ice breaker, if necessary. In order to increase the capacity it is also possible to provide another material inlet chute opposite to that shown in FIG. 1 in that, as disclosed above, only half of the rotor is used at one time with the apparatus of FIG. 1.

As mentioned above, the air flow through the separator is of importance for several reasons. First of all, it is important to collect the smallest particles. Here, the smallest particles are considered to be particles having sizes less than 0.4" (1 mm) in mean diameter, such as dust. Secondly, the air flow is important to disturb and prevent the smaller fraction of material from traveling along the same ballistic curve as the larger fraction in order to provide separation. The air flow is also important for transporting the smaller fractions to a desired place for disposition and to provide pneumatic cleaning of the accepts via the counterflow.

With respect to the collection of the smallest particles, all accepts will pass an opposite air stream having a low velocity in that most of the intake air comes through the accepts discharge. The smallest particles which can easily be transported with low air velocity will be collected by the counterflow between the outer and inner cones of the separator. The rotor will create a movement in the air by its rotation and the smallest particles would tend to move upwardly in a dust cloud and, in some cases, follow the accepts, if it were not for the counterflow which collects the smallest particles and transports the same into the rejects chamber.

The following should be considered with respect to the disturbance of the smaller fraction. In a vacuum, the throw length of a particle is independent of the size of the particle and follows the relationship $$\frac{W = Vo^2 \times \sin 2\alpha}{g},$$

where W is the throw length in meters, Vo is the initial velocity in meters per second, $\alpha$ is the throw angle in degrees, and g is the acceleration due to gravity in meters per second per second.

However, it is well known that a low air velocity can disturb small particles with low energy and instead of a straight ballistic curve, the small particles can be influenced to traverse a different path, for example a sine curve. For this reason there is a way to separate one or more fractions from another when using centrifugal force together with an air stream.

As also mentioned above, it is desirable to transport the smaller fractions to a desired location. The fines/-flour fraction is transported by pneumatic conveying which has the benefits of low investment cost, a dust sealed system and ease of modification. Therefore, it is advantageous to use the same air flow within the rotary separator to convey the smallest fraction to the desired location which can be some distance away.

Inasmuch as all accepts will pass an air stream while traversing the separator, even small particles which adhere to larger particles, such as through moisture and the like, can be separated.

Alternatives in construction may be made; for example, more than two concentric chambers may be provided for separating more than two constituent parts of a mixture. Also, as mentioned above, more than one feed may be provided so as to increase the throughput and an ice breaker may be provided, for example in the center of the separator.

Although I have described my invention by reference to a particular illustrative embodiment thereof many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. Separator apparatus for separating a mixture of a plurality of particle constituents of different sizes, comprising: chamber means defining a plurality of concentric chambers, each of said chambers comprising an inlet opening for receiving and a discharge opening for discharging a respective particle constituent; a rotor mounted above said plurality of chambers, the inlet opening of the innermost of said concentric chambers being at least partially radially outward from said rotor; drive means connected to and operable to rotate said rotor; feed means for feeding the mixture of a plurality of particle constituents onto said rotor to subject the same to centrifugal forces which discharge the particle constituents over the periphery of said rotor, said rotor effecting an initial separation between larger and smaller particle constituents and discharging said constituents along different paths related to their respective surface area to mass ratios to fall into respectively located ones of said inlet openings of said concentric chambers; and air flow means in communication with said discharge openings of said chambers providing a flow of air for entraining and transporting away the smaller of said particle constituents from the larger of said particle constituents and for influencing the paths of smaller particle constituents toward the innermost of said concentric chambers.

2. The separator apparatus of claim 1, wherein: said rotor comprises a disk including upper and lower surfaces and a pattern of grooves in said upper surface opening through the periphery of said disk.

3. The separator apparatus of claim 1, and further comprising: a housing including said plurality of concentric chambers each of which comprises at least one wall downwardly convergent towards the axis of rotation of said rotor and terminating at the respective discharge means.

4. Separator apparatus for separating pin chips and fines from a mixture thereof, comprising: first chamber means defining a first chamber; second chamber means defining a second chamber about and concentric with said first chamber; feed means for feeding a mixture of pin chips and fines to a predetermined location above said first and second chambers; a rotor mounted for rotation above said first and second chambers for receiving the mixture thereon, said rotor being adapted to segregate a significant portion of the fines from the pin chips for subsequently imparting centrifugal forces to the pin chips different from the fines, to direct the pin chips toward and into said second chamber and the fines toward and into said first chamber; drive means connected to and operable to rotate said rotor; said first chamber means and said second chamber means respectively including inlet means for receiving their respective constituents and discharge means for discharging their respective constituents; said inlet means of said second chamber means being radially outward from said inlet means of said first chamber means, and said inlet means of said first chamber means being at least partly radially outward from said rotor; and air flow means connected in communication with each said discharge means and operable to provide a flow of air to entrain and carry off said fines including at least some fines initially carried into said second chamber.

5. The separator apparatus of claim 4, and further comprising: a housing including said first and second chamber means each of which comprise at least one wall downwardly convergent towards the axis of rotation of said rotor and terminating at the respective discharge means.

6. The separator apparatus of claim 5, wherein: said housing further comprises an upper wall mounting said drive means.

7. The separator apparatus of claim 4, wherein: said feed means comprises a feed chute positioned to direct the pin chip and fines mixture onto a central portion of said rotor.

8. The separator apparatus of claim 4, wherein: said drive means comprises a drive device and a shaft connected to said drive device and carrying said rotor.

9. The separator apparatus of claim 8, wherein: said drive device comprises a variable speed motor for varying the speed of rotation of said rotor and the centrifugal forces imparted to the mixture of pin chips and fines.

10. The separator apparatus of claim 8, wherein: said drive device comprises adjustable means for changing the height of said rotor and the path of travel of said pin chips and said fines into their respective chambers.

11. The separator apparatus of claim 4, wherein: said air flow means comprises a conduit connected in communication with said first chamber discharge means, fan means connected to said conduit, and air inlet means closely associated with said second chamber discharge means for creating an air flow through said second chamber in a direction opposite to the flow of chips through said second chamber and directed through said first chamber in the same direction as the flow of chips through said first chamber.

12. The separator apparatus of claim 11, wherein: said conduit includes an adjustable damper for controlling the air flow.

13. The separator apparatus of claim 4, and further comprising a conveyor beneath said second chamber discharge means for carrying off the pin chips.

14. Separator apparatus for separating pin chips and fines from a mixture thereof, comprising: a housing including an upper wall, at least one side wall depending from said upper wall, a crossbar extending from said at least one side wall, a first downwardly convergent wall depending from said crossbar forming a rejects chamber for the fines and terminating at a fines discharge opening, and a second downwardly convergent wall depending from said at least one sidewall spaced from said first downwardly convergent wall to form an accepts chamber for the pin chips and terminating at a pin chips discharge opening; drive means mounted on said upper wall and including a rotatable shaft extending through said upper wall and journaled on said crossbar; a feed chute for charging the mixture into the separator apparatus; a conveyor below said pin chips discharge opening for carrying off the pin chips; a conduit extending through and sealed from said accepts chamber and connected in communication with said fines discharge opening, and means for producing an air flow through said conduit and extending from said pin chips discharge opening to said conduit via said accepts and rejects chambers to entrain and carry off the fines; and a rotor carried on said shaft adjacent said feed chute and above said accepts and rejects chambers for receiving the mixture thereon and imparting centrifugal forces to the pin chips and fines to propel the pin chips and fines over the periphery of said rotor and into the respective accepts and rejects chambers.

15. The separator apparatus of claim 14, wherein: the periphery of said rotor is radially spaced from said first downwardly convergent wall.

16. The separator apparatus of claim 14, wherein: the periphery of said rotor extends over said first downwardly convergent wall.

17. A method of separating a mixture of pin chips and fines into constituent parts, comprising the steps of: feeding a mixture of pin chips and fines to a separating station; agitating the mixture to dislodge fines from pin chips; capturing a substantial portion of the fines apart from the pin chips; inducing by centrifugal force different radial trajectories for said pin chips than for said fines so that the pin chips travel along respective first paths into a first zone below and radially outward from the separating station, a portion of the pin chips carrying fines therewith, and the fines travel along respective second radially outward paths into a second zone adjacent the first zone; producing an air stream upwardly through the first zone to clean the fines from that portion of the pin chips carrying the same and to carry those fines into the second zone, and downwardly through the second zone to entrain and carry off the fines as a discharge of the fines; and discharging the pin chips from the first zone.

* * * * *